US006367402B1

(12) United States Patent
Weiler

(10) Patent No.: US 6,367,402 B1
(45) Date of Patent: Apr. 9, 2002

(54) MULTI-USE CONSTRUCTION VESSEL

(75) Inventor: Robert F. Weiler, Destrehan, LA (US)

(73) Assignee: J. Ray McDermott, S.A., Houston, TX (US)

( * ) Notice: Subject to any disclaimer, the term of this patent is extended or adjusted under 35 U.S.C. 154(b) by 0 days.

(21) Appl. No.: 09/542,357

(22) Filed: Apr. 4, 2000

(51) Int. Cl.[7] ..... B63B 35/40
(52) U.S. Cl. ..... 114/259; 114/77 A
(58) Field of Search ..... 114/258, 259, 114/260, 151, 144 B, 77 R, 77 A, 72

(56) References Cited

U.S. PATENT DOCUMENTS

| | | | | | |
|---|---|---|---|---|---|
| 2,406,084 | A | * | 8/1946 | Levin | 114/77 R |
| 3,417,721 | A | * | 12/1968 | Vienna | 114/260 |
| 3,556,036 | A | * | 1/1971 | Wells | 114/260 |
| 3,823,681 | A | * | 7/1974 | Cushing et al. | 114/260 |
| 4,069,785 | A | * | 1/1978 | Bordes | 114/47 |
| 4,382,419 | A | * | 5/1983 | Drimmelen | 114/313 |
| 4,825,791 | A | * | 5/1989 | Foster, Jr. et al. | 114/72 |
| 4,898,112 | A | * | 2/1990 | McGlew et al. | 114/255 |
| 5,522,335 | A | * | 6/1996 | Veronesi et al. | 114/151 |

FOREIGN PATENT DOCUMENTS

| | | | | |
|---|---|---|---|---|
| GB | 2004-818 | * | 4/1979 | 114/259 |
| GB | 2075432 | * | 11/1981 | 114/260 |
| JP | 63-49594 | * | 3/1988 | 114/259 |
| JP | 404-266587 | * | 9/1992 | 114/259 |

* cited by examiner

*Primary Examiner*—S. Joseph Morano
*Assistant Examiner*—Ajay Vasudeva
(74) *Attorney, Agent, or Firm*—D. Neil LaHaye; Rob Baraona; Eric Marich

(57) ABSTRACT

A multi-use construction vessel designed to receive a variety of float-on modules that accommodate project specialty equipment and still allow the mother vessel to operate in the traditional construction mode. The vessel may be formed as a new construction or by converting an existing vessel. The vessel is provided with a lowered center section between the bow and stern. The center section is adapted to receive and secure float-on modules containing the equipment required for the desired operation. The center section may also be provided with a moon pool for laying pipeline directly through the vessel. The vessel is ballasted to position the center section below the water line so that the float-on modules may be installed or removed. The stern section of the vessel includes a derrick crane for normal construction lifts and moving pipe and equipment on the center section as necessary.

2 Claims, 9 Drawing Sheets

MULTI-USE CONSTRUCTION VESSEL

BACKGROUND OF THE INVENTION

1. Field of the Invention

The invention is generally related to vessels used to provide offshore construction services and more particularly to a vessel that is adaptable to provide a variety of services.

2. General Background

In the production of hydrocarbons offshore, a variety of services are required. These services include laying pipeline on the sea floor and the installation of structures and equipment used in the drilling and production of hydrocarbons. The means used to lay pipeline depends upon a variety of factors such as water depth and pipe diameter. Directing the pipeline into the water at an angle nearly vertical to the water surface is typically used in deep water. This is generally referred to as J-Lay. Directing the pipeline into the water at a relatively shallow angle is typically used in shallow water. This is generally referred to as S-Lay. Each method uses different equipment to accomplish the task. J-Lay may use a near vertical support and stinger. In S-Lay, the pipe may be unwound from a reel as it is laid or pipe joints may be welded together on the laying vessel during the laying operation. Installing equipment and structures requires the use of lowering equipment such as cranes capable of handling the weight of the equipment.

Having one vessel capable of performing each operation is expensive as this can result in a vessel remaining idle when the specific operation that it is dedicated is not required. Also, current vessels dedicated to specific tasks are only capable of speeds at six to seven knots.

The current state of the art leaves a need for vessels that have multiple use capability and greater speed.

SUMMARY OF THE INVENTION

The invention addresses the above need. What is provided is a multi-use construction vessel designed to receive a variety of float-on modules that accommodate project specialty equipment and still allow the mother vessel to operate in the traditional construction mode. The vessel may be formed as a new construction or by converting an existing vessel. The vessel is provided with a lowered center section between the bow and stern. The center section is adapted to receive and secure float-on modules containing the equipment required for the desired operation. The center section may also be provided with a moon pool for laying pipeline directly through the vessel. The vessel is ballasted to position the center section below the water line so that the float-on modules may be installed or removed. The stern section of the vessel includes a derrick crane for normal construction lifts, moving pipe, and equipment on the center section as necessary.

BRIEF DESCRIPTION OF THE DRAWINGS

For a further understanding of the nature and objects of the present invention reference should be made to the following description, taken in conjunction with the accompanying drawing in which like parts are given like reference numerals, and wherein.

DETAILED DESCRIPTION OF THE PREFERRED EMBODIMENT

Figure 1:
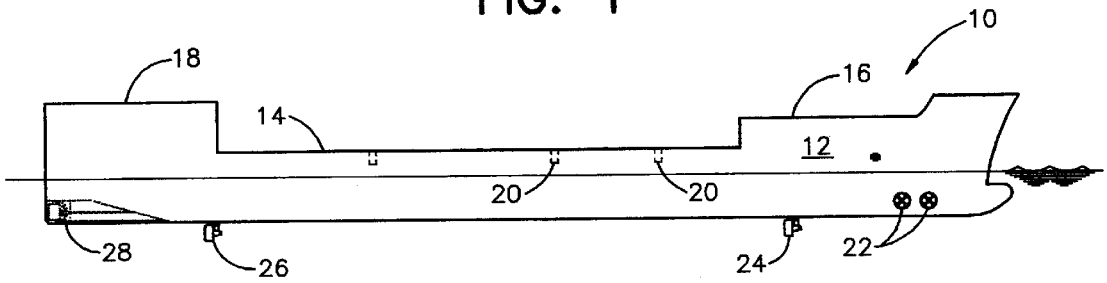
FIG. 1 is an elevation view of the vessel of the invention.

Referring to the drawings, it is seen in FIG. 1 that the invention is generally indicated by the numeral 10. The multi-use construction vessel 10 is generally comprised of a buoyant, self-propelled ship 12. For the sake of clarity, the forward house is not shown in FIG. 1–4.

The mid-ship deck 14 is lower than the fore and aft decks 16, 18. It is preferable that the mid-ship deck 14 provide approximately forty feet of depth from the bottom of the ship to the deck. The mid-ship deck 14 is provided with a plurality of docking ports 20.

The ship is provided with several thrusters. Tunnel thrusters 22 are positioned near the bow. Full three hundred sixty degree rotating, retracting, thrusters 24 are positioned forward just aft of the fore deck 16. Full three hundred sixty degree rotating, retracting, thrusters 26 are positioned aft at the forward end of the aft deck 18. Standard ship-type controllable-pitch propellers 28 with rudders are provided at the stern. Although not shown, it is preferable two each of thrusters 24 and 26 be provided and spaced across the hull. It is preferable that the propellers 28 be in tunnels with balanced rudders.

The ship 12 may be built as a new construction or by converting an existing oil tanker. For the type of work envisioned, the preferred ship size for conversion is approximately eight hundred to nine hundred feet long, one hundred fifty to one hundred seventy feet wide, and seventy to eighty feet deep at the fore and aft decks. Existing oil tankers fit within these parameters and thus conversion will save time and money over new construction.

To convert an oil tanker, the aft portion of the ship that houses all machinery and accommodations are removed to obtain a "barge shape" approximately five hundred sixty feet long with the bow remaining. The mid-ship deck is cut out and lowered to reduce its overall depth to approximately forty feet, with a length of approximately three hundred feet. A derrick crane is mounted on the remaining aft deck 18. The fore deck 16 is modified to become the forecastle deck to accept crew accommodations and a heli-deck.

Figure 2:
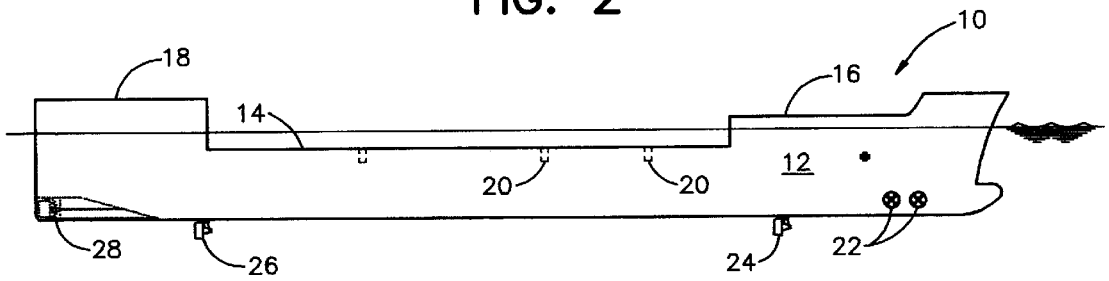
FIG. 2 is an elevation view that illustrates the vessel ballasted in position to received float-on modules.

In operation, the ship 12 is ballasted to lower the midship deck 14 approximately ten feet below the water surface as shown in FIG. 2. One or more float-on modules 30 are floated above the mid-ship deck 14 and positioned to align docking probes 32 with the docking ports 20. The ship 12 is then de-ballasted to raise the mid-ship deck 14 into contact with the float-on modules 30 such that the docking probes 32 are received in the docking ports 30.

Figure 5:
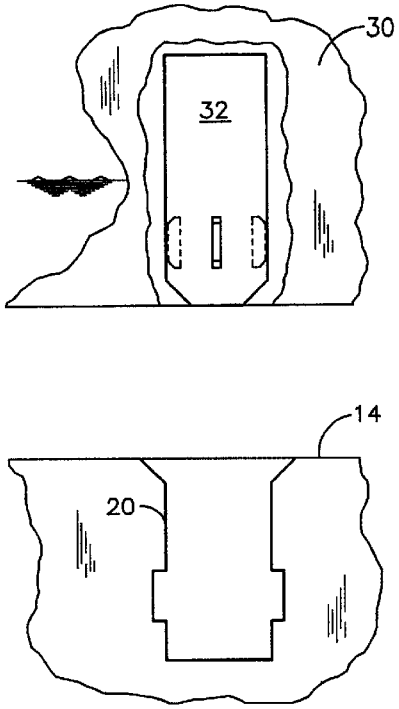
FIG. 5–9 are enlarged detail views of a docking probe and docking port and illustrate the connection sequence.
Figure 6:
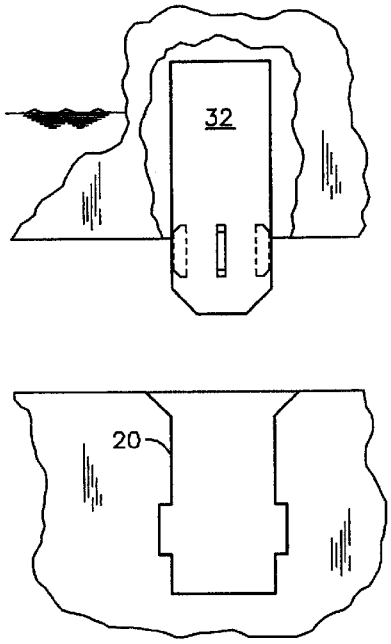
Figure 7:
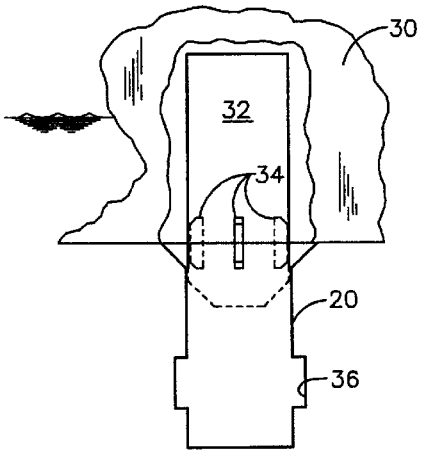
Figure 8:
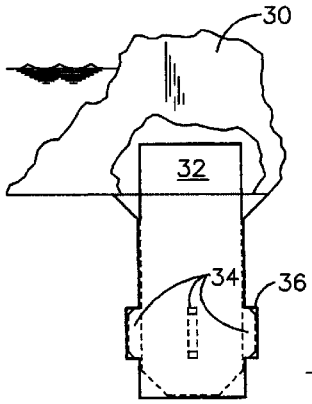
Figure 9:
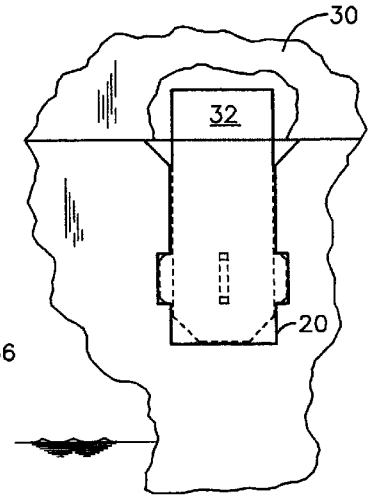

FIG. 5 illustrates the initial position of the module 30 over the deck 14. It can be seen that the docking probe 32 is at first retracted position in the module 30. FIG. 6 illustrates the docking probe 32 moving to its second extended position toward the docking port 20. FIG. 7 illustrates the docking probe 32 being received in the docking port 20 during the initial de-ballasting of the ship. FIG. 8 illustrates the docking probe 32 fully inserted and extended into the docking port 20. The locking dogs 34 provided on the docking probe 32 are moved to their second extended position and received in complementary recessed grooves 36 in the docking port 20 to lock the module 30 in position. As indicated by the water line, FIG. 9 illustrates the vessel after it has been de-ballasted and is at the normal operating draft.

Figure 3:
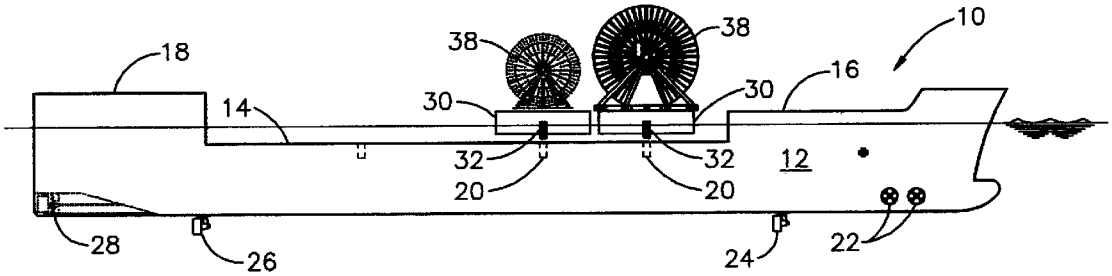
FIG. 3 is an elevation view illustrating float-on modules positioned over the mid-ship deck of the vessel.
Figure 4:
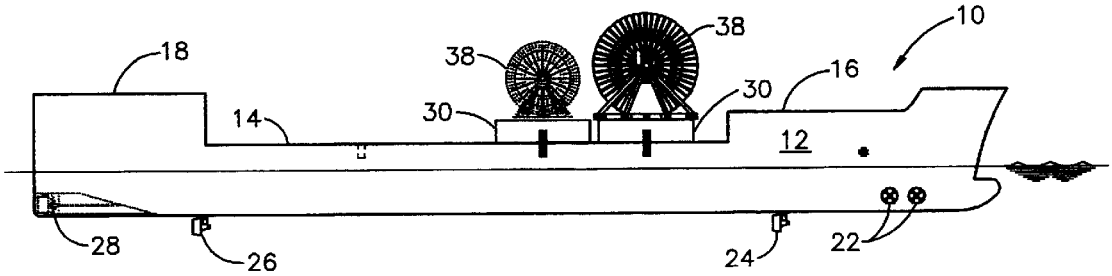
FIG. 4 is an elevation view illustrating the vessel ballasted up with the float-on modules received on the mid-ship deck.
Figure 10:
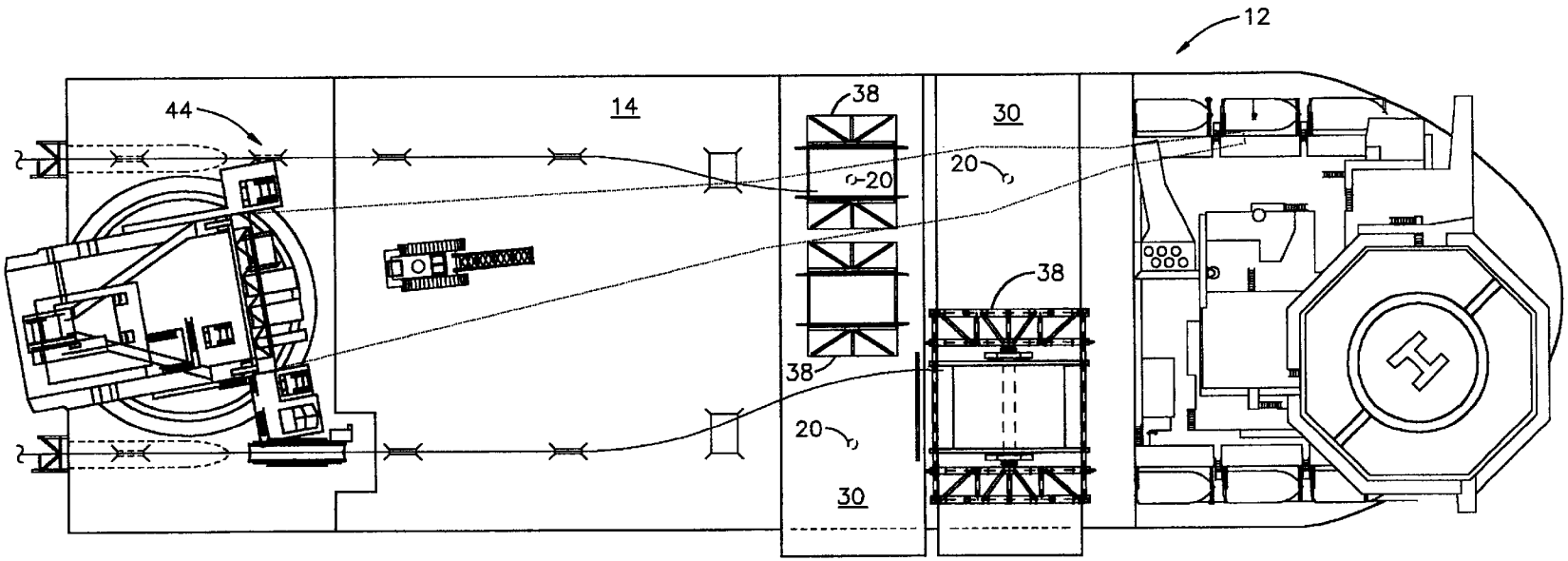
FIG. 10 is a plan view of the invention set up reels for laying pipeline.
Figure 11:
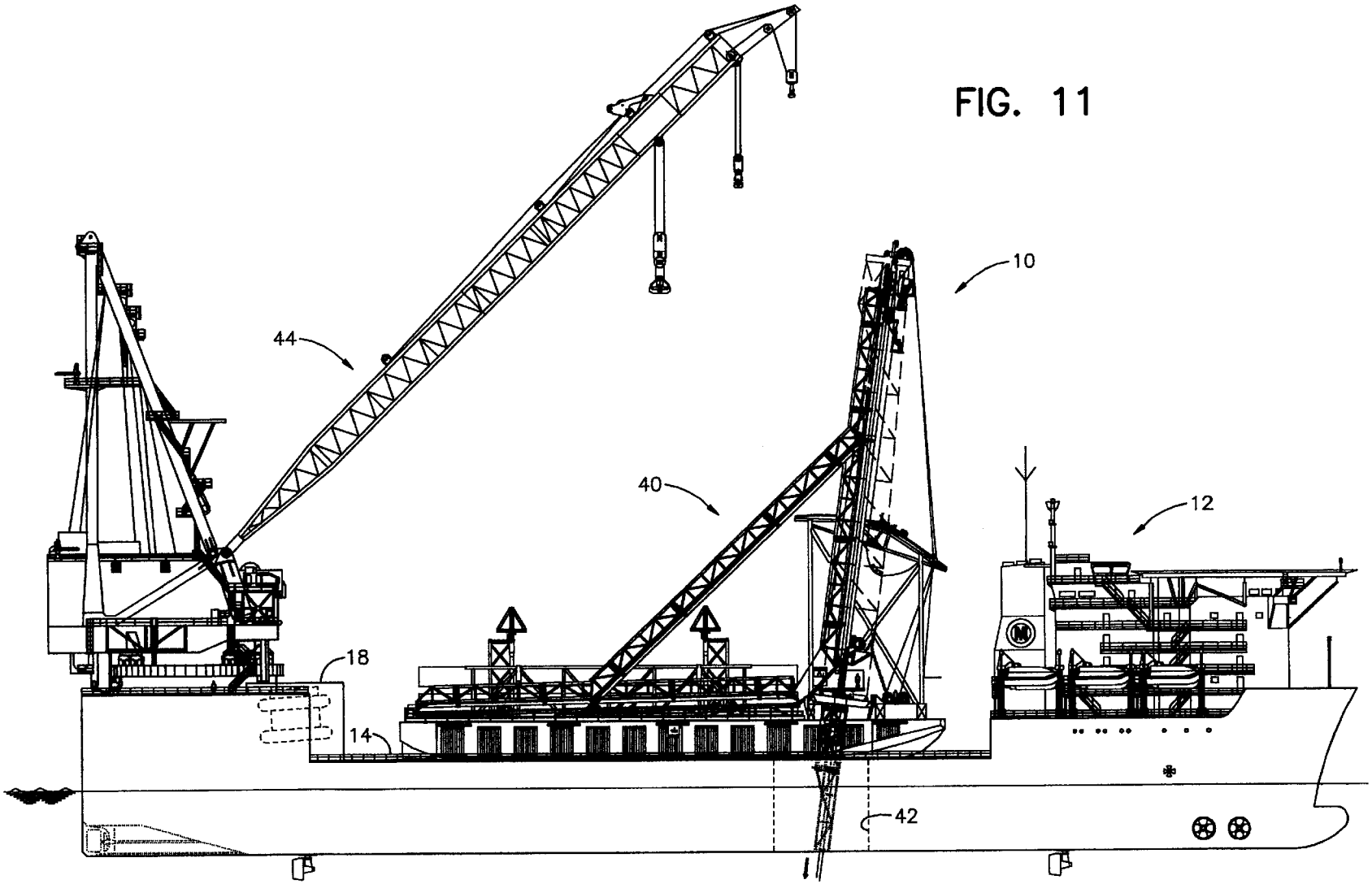
FIG. 11 is an elevation view of the invention set up with J-Lay equipment.
Figure 12:
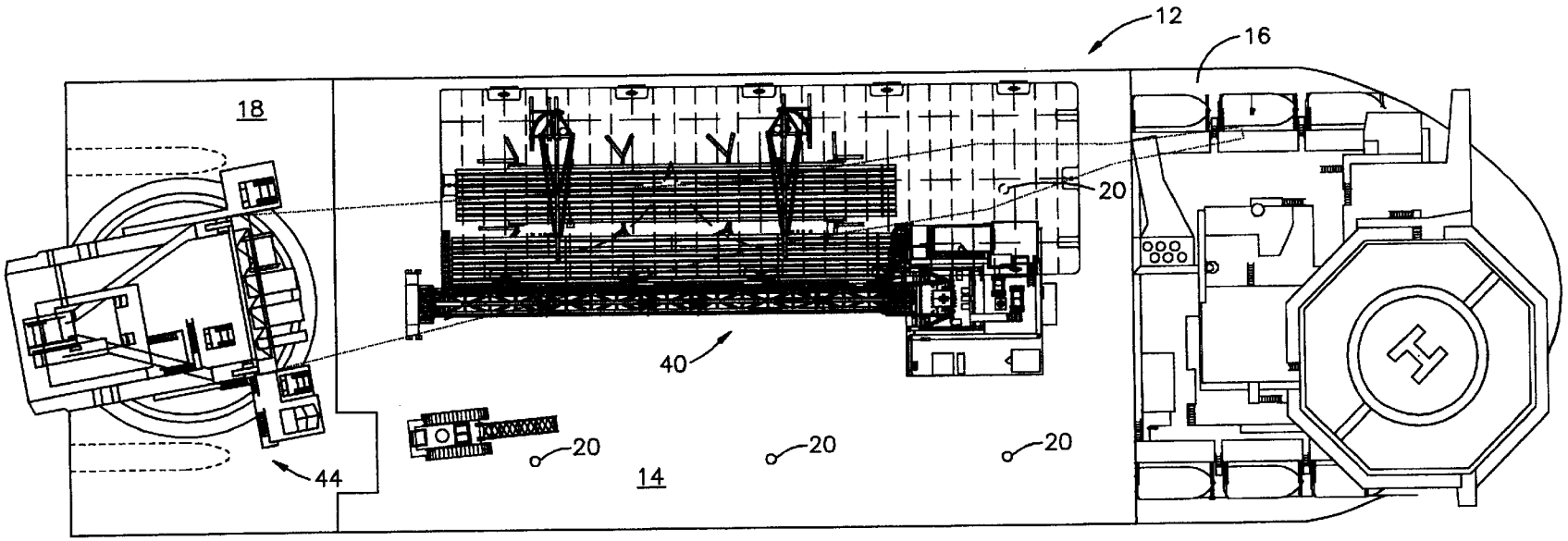
FIG. 12 is a plan of the invention as set up in FIG. 11.
Figure 13:
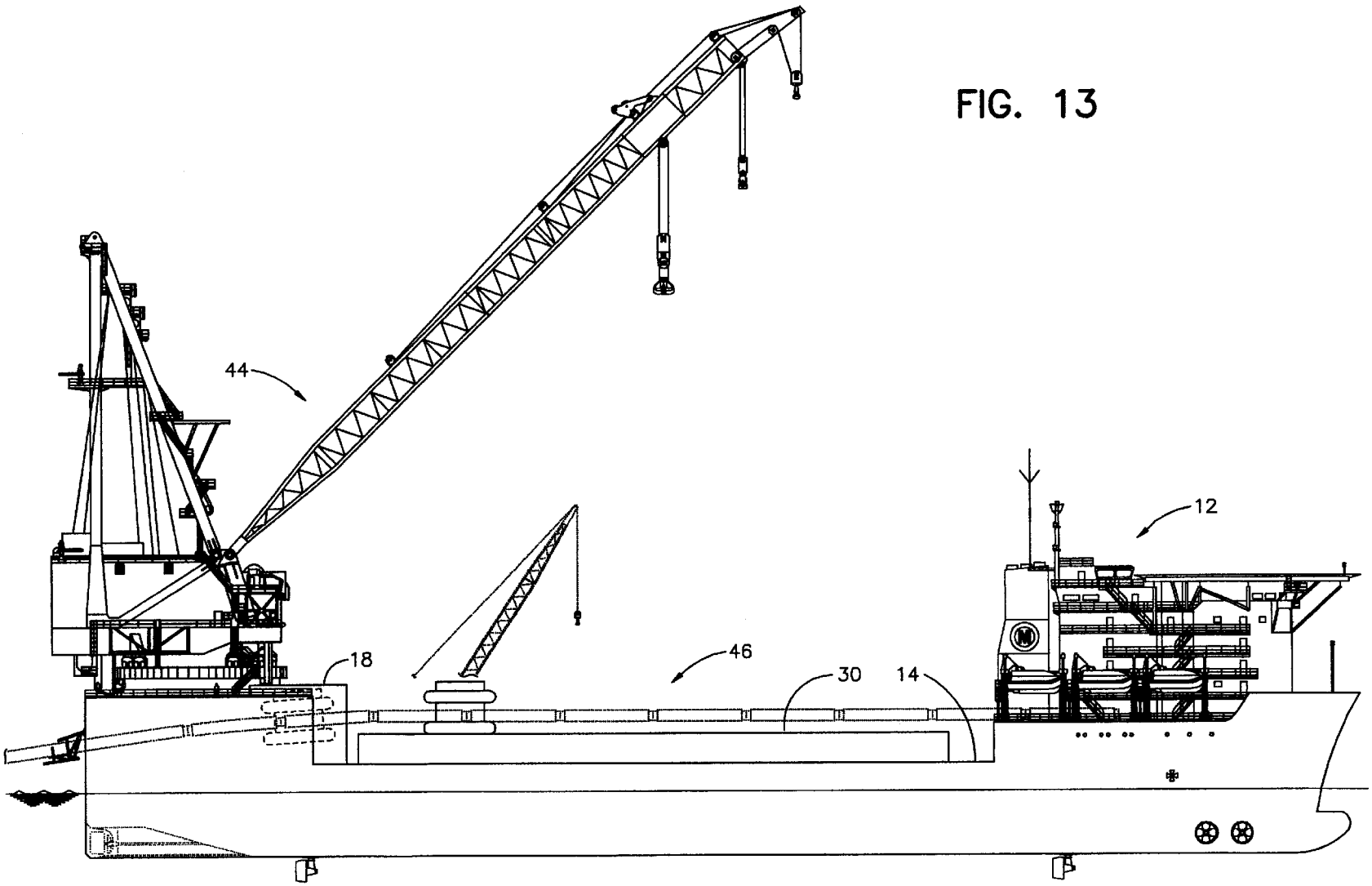
FIG. 13 is an elevation view of the invention set up with S-Lay equipment
Figure 14:
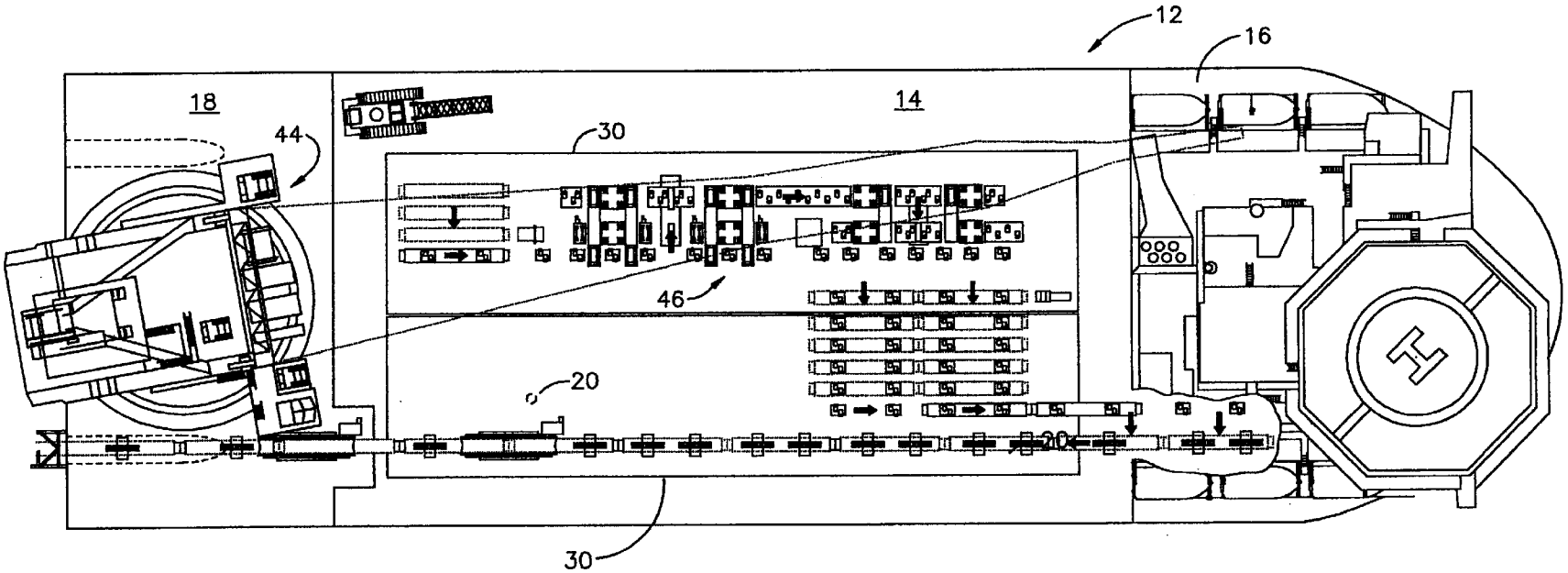
FIG. 14 is a plan view of the invention as set up in FIG. 13.
Figure 15:
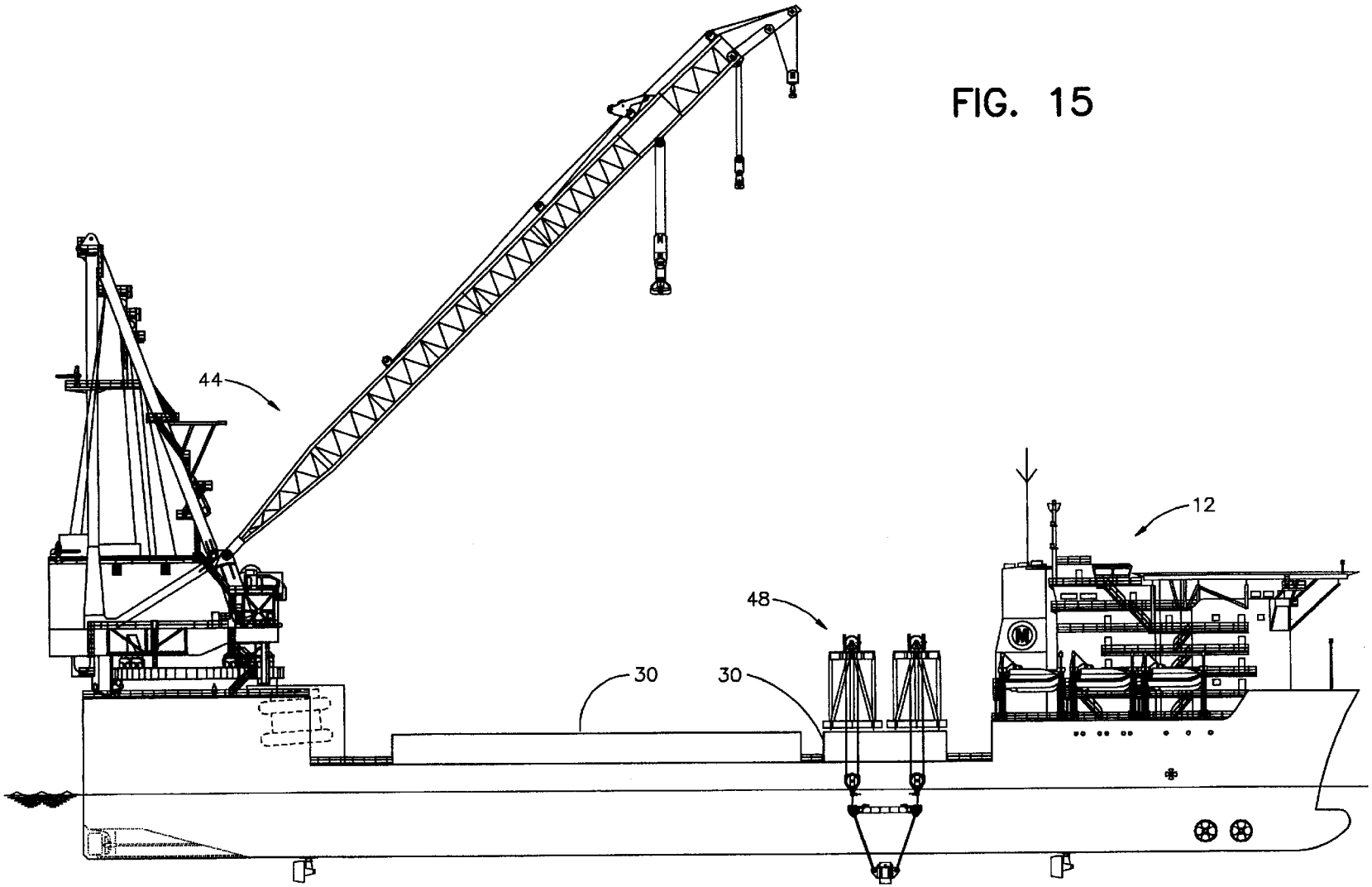
FIG. 15 is an elevation view of the invention set up with lowering equipment.
Figure 16:
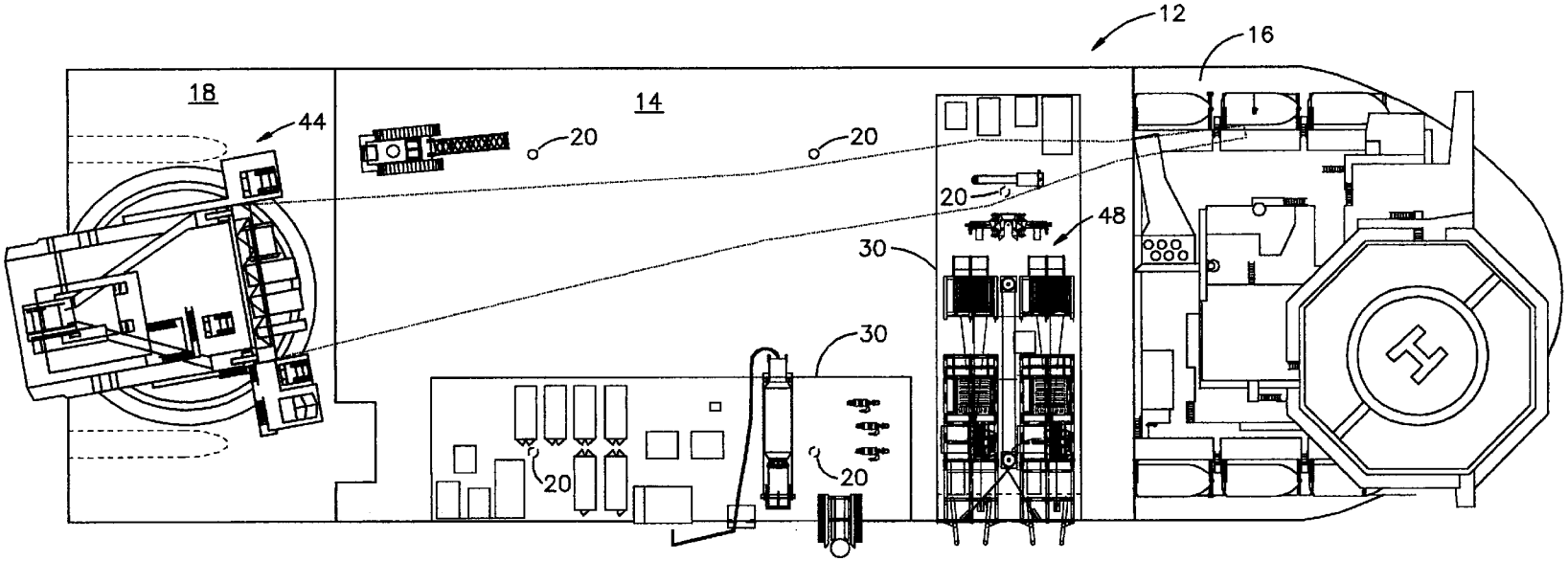
FIG. 16 is a plan view of the invention as set up in FIG. 15.

FIG. 3 and 4 illustrate the presence of pipe reels 38 on the modules 30. However, as seen in FIG. 10–16, the modules 30 may be used for a variety of equipment for different operations. It is also seen in these Figures that a derrick crane 44 is provided on the aft deck 18. FIG. 10 is a plan view of the vessel with the modules having pipe reels 38 as seen in FIG. 3 and 4. FIG. 11 and 12 illustrate modules 30 with equipment 40 for laying pipeline in the J-Lay mode through a moon pool 42. Laying pipeline in the J-Lay mode may also be accomplished over the side of the vessel. FIG. 13 and 14 illustrate modules 30 with equipment 46 for laying pipeline in the S-Lay mode. FIG. 15 and 16 illustrate modules 30 with equipment for lowering equipment to the sea floor.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A method for providing a selected offshore construction service from a ship at sea, comprising the steps of:

a. providing a ship having a derrick crane, a fore deck, a mid-ship deck, and an aft deck, with the mid-ship deck being lower than the fore and aft decks;

b. providing a plurality of docking ports on the mid-ship deck;

c. ballasting the ship to submerge the mid-ship deck below the water surface;

d. selecting an offshore construction service to be performed from the ship;

e. floating a module having docking probes and being designed to provide the selected offshore construction service over the submerged mid-ship deck such that the docking probes are aligned with the docking ports on the mid-ship deck and the module is positioned to provide the selected offshore construction service when the module is received on the ship; and f. deballasting the ship such that the docking probes on the module are received in the docking ports and the mid-ship deck is above the water surface.

2. The method of claim 1, further comprising locking the docking probes on the module in the docking ports.

* * * * *